US005862768A

United States Patent [19]

Tsukahara

[11] Patent Number: 5,862,768

[45] Date of Patent: Jan. 26, 1999

[54] SEWING MACHINE CONTROLLER

[75] Inventor: Hisaaki Tsukahara, Tokyo, Japan

[73] Assignee: Mitsubishi Denki Kabushiki Kaisha, Tokyo, Japan

[21] Appl. No.: 858,920

[22] Filed: May 19, 1997

[30] Foreign Application Priority Data

Jan. 17, 1997 [JP] Japan ..... 9-006913

[51] Int. Cl.[6] ..... D05B 19/00

[52] U.S. Cl. ..... 112/470.01; 112/277

[58] Field of Search ..... 112/277, 470.01, 112/470.02, 300, 445; 364/470.07, 470.08, 470.09

[56] References Cited

U.S. PATENT DOCUMENTS

| | | | |
|---|---|---|---|
| 4,359,953 | 11/1982 | Martell et al. | 112/470.02 |
| 4,738,132 | 4/1988 | Tew | 112/1 X |
| 5,050,513 | 9/1991 | Frankel | 112/470.02 |

FOREIGN PATENT DOCUMENTS

| | | | |
|---|---|---|---|
| 2719610A1 | of 0000 | Germany . | |
| 60-234686 | 11/1985 | Japan | D05B 25/00 |
| 64-37989 | 2/1989 | Japan | D05B 19/00 |

OTHER PUBLICATIONS

Bekleidung und Wasche Aug. 1980, page 480 to 482 under Variocontrol.

*Primary Examiner*—Peter Nerbun

*Attorney, Agent, or Firm*—Sughrue, Mion, Zinn, Macpeak & Seas, PLLC

[57] ABSTRACT

A sewing machine controller comprises sewed cloth (107) moving in a plurality of sewing directions, a sewing machine motor 11 for moving a sewing machine needle (5) up and down for sewing the sewed cloth (107), direction change detection means for detecting a sewing direction of the sewed cloth (107) being changed, operation time detection means for detecting the operation time of the sewing machine motor (11), when the direction change detection means does not detect a change in the sewing direction, stop time detection means for detecting the stop time of the sewing machine motor, when the direction change detection means detects a constant sewing direction, stop time comparison means for comparing the stop time value with a first preset time value, when the sewing direction is constant, operation time comparison means for comparing the operation time value with a second preset time value, when the sewing direction is constant, and display means (35) for displaying the results of the stop time comparison means and the operation time comparison means.

5 Claims, 5 Drawing Sheets

SEWING MACHINE CONTROLLER

BACKGROUND OF THE INVENTION

This invention relates to an improvement in a sewing machine controller and more particularly to a sewing machine controller for computing work efficiency to sew a piece of cloth and determining whether or not the work efficiency or sewing is good, thereby improving the productivity of sewing.

A conventional sewing machine controller will be discussed with reference to FIG. 6. In the figure, a sewing machine 1 comprises a sewing machine mechanism section 9 containing a mechanism for forming seams on cloth 7 with a sewing machine needle 5 on the top of a sewing machine table 3, a sewing machine motor 11 for driving the sewing machine mechanism section 9, a cloth press section 13 for pressing and holding the cloth 7, a thread cutting mechanism 15 for cutting thread with which the cloth 7 is sewed, a pedal 19 having a signal generation section 17 for generating a thread cutting command given to the thread cutting mechanism 15 and turning and speed commands of the sewing machine motor 11, a sewing machine needle detector 21 for detecting the position of the sewing machine needle 5, thereby counting the number of sewing times of the sewing machine needle 5, and a controller 23 being disposed in a wing of the sewing machine table 3 for controlling the operation of the components.

The controller 23 comprises an operation command section 25 for generating sewing machine operation commands based on a signal of the depressing amount of the pedal 19 input from the signal generation section 17, a sewing machine needle 5 position detection signal input from the sewing machine needle detector 21, etc., a motor drive section 27 for driving the sewing machine motor 11 in response to output of the operation command section 25, a thread cutting drive section 29 consisting of a solenoid, etc., for driving the thread cutting mechanism 15 in response to output of the operation command section 25, a motor operation time counter 31 for integrating the on time of output of the motor drive section 27, a sewing machine operation time counter 33 for integrating the on time of an operation switch 23*a* of the controller 23, namely, the operation time of the controller 23, and a display section 35 for displaying both the motor operation time counter 31 and the sewing machine operation time counter 33 on a liquid crystal display, etc., through the operation command section 25.

The operation for sewing cloth 7 with the sewing machine configured as described above will be discussed with reference to FIG. 6. First, a worker places cloth 7 on the table 3 and presses and holds the cloth 7 under the cloth press section 13. The worker turns on the operation switch 23*a* of the controller 23. When the off-to-on transition of the signal is made, the sewing machine operation time counter 33 counts the on time of the controller 23 and the time is displayed on the display section 35 through the operation command section 25. The controller 23 is turned on only when the sewing machine 1 is operated, and is turned off when the sewing machine 1 stops. Thus, the integral of the operation time of the controller 23 is assumed to be the operation time of the sewing machine 1.

Next, to start sewing, the worker depresses the pedal 19. A signal is input through the signal generation section 17 to the operation command section 25 in response to the depressing amount of the pedal 19. The operation command section 25 turns the sewing machine motor 11 through the motor drive section 27 at the rotation speed responsive to the depressing amount of the pedal 19. The sewing machine motor 9 operates the needle 5 through the sewing machine mechanism section 9 for sewing the cloth 7. On the other hand, the motor operation time counter 31 counts the time during which the motor drive section 27 generates a motor turning command, and the count is displayed on the display section 35 through the operation command section 25.

At the termination of sewing the cloth 7, the worker takes his or her foot off the pedal 19. A stop signal is input from the pedal 19 through the signal generation section 17 to the operation command section 25, which then stops generating the motor operation command given to the motor drive section 27. In response to the stop signal, the motor operation time counter 31 stops counting and the count Ta is displayed on the display section 35.

Next, the worker kicks the pedal 19. A kick signal from the pedal 19 is input through the signal generation section 17 to the operation command section 25, which then gives a thread cutting signal to the thread cutting drive section 29 for operating the thread cutting mechanism 15 for cutting the thread.

Upon completion of a predetermined number of pieces of cloth 7 by repeating the operation of the sewing machine as described above, the worker turns off the power switch 23*a*. The sewing machine operation time counter 33 stops counting and the count To is displayed on the display section 35 through the operation command section 25.

Next, the work efficiency of the cloth 7 is determined by the actual work time and the stop time per piece of the cloth 7. First, the actual work time is found by dividing the integral value Ta of the motor operation time displayed on the display section 35 by the number of sewed pieces of cloth with a calculator, etc.

The stop time is assumed to be the stop time of the sewing machine 11. From the count To of the sewing machine operation time counter 33, the integral value Ta of the motor operation time, and the number of sewed pieces of cloth, n, the stop time per piece of cloth, $tr=(To-Ta)/(n-1)$ is found. The finished cloth 7 is visually checked as quality inspection before shipment.

However, the conventional sewing machine controller involves a problem of improper grasping of work efficiency. First, the actual work time per piece is found from the operation time of the sewing machine 1 and the number of sewed pieces, but accurately the time to finishing of cloth 7 is not only the operation time of the sewing machine motor 11. That is, to finish cloth 7, the sewing direction is changed and the thread is cut after the sewing machine motor 11 is stopped; the time is also contained in the above-mentioned actual work time.

Second, since the total actual work time to finishing of one sewing product is found, the found time is not related to the form, sewing pattern, etc., of cloth 7. Thus, if the work time is determined to be long, which sewing part is the cause of prolonging the actual work time is not made clear; it is difficult to remove the cause for shortening the work time.

Third, since quality inspection is executed for weeding out defective items after cloth 7 is finished, the quality inspection step is also contained in the time to finishing of cloth 7; resultantly, the inspection step lowers the total work efficiency.

Fourth, for the worker to adjust the depressing amount of the pedal 19 of the sewing machine with his or her foot, it is empirically known that the worker needs also take care of his or her foot, lowering the work efficiency; the countermeasure is insufficient.

SUMMARY OF THE INVENTION

It is therefore an object of the invention to provide a sewing machine controller for determining work efficiency for each part of cloth sewed by a sewing machine, making the depressing amount of a pedal appropriate, and enabling a worker to make a quality check at the sewing stage.

According to a first aspect of the invention, there is provided a sewing machine controller for sewing cloth having a plurality of sewing directions comprising; a sewing machine motor for moving a sewing machine needle up and down for sewing the sewed cloth; direction change detection means for detecting a sewing direction of the sewed cloth being changed; operation time detection means for detecting the operation time of the sewing machine motor, (when the direction change detection means does not detect a change in the sewing direction); stop time detection means for detecting the stop time of the sewing machine motor, (when the direction change detection means does not detect a change in the sewing direction); stop time comparison means for comparing the stop time value with a first preset time value, when the sewing direction is constant; operation time comparison means for comparing the operation time value with a second preset time value when the sewing direction is constant; and display means for displaying the results of the stop time comparison means and the operation time comparison means.

According to a second aspect of the invention, there is provided a sewing machine controller for sewing cloth having a plurality of sewing directions comprising; a sewing machine motor for moving a sewing machine needle up and down for sewing the sewed cloth; direction change detection means for detecting a sewing direction of the sewed cloth being changed; number-of-stitches detection means for counting the number of stitches put in the sewed cloth; operation time detection means for detecting the operation time of the sewing machine motor when the direction change detection means does not detect a change in the sewing direction; sewing speed computation means for computing the sewing speed for each sewing in a constant direction of the sewed cloth based on the operation time value detected by the operation time detection means and the number of stitches counted by the number-of-stitches detection means; and display means for displaying the sewing speed.

According to a third aspect of the invention, there is provided a sewing machine controller comprising rotation time detection means for detecting the rotation time of a sewing machine motor for moving a sewing machine needle up and down for sewing sewed cloth; number-of-revolutions detection means for detecting the number of revolutions of the sewing machine motor; a time counter operating, if the number of revolutions detected by the number-of-revolutions detection means is greater than a predetermined number of revolutions of the sewing machine motor; comparison means for comparing a count value of the time counter with a predetermined time value; and display means for displaying the comparison result of the comparison means.

According to a fourth aspect of the invention, the sewing machine controller further comprises; number-of-stitches detection means for counting the number of stitches put in the sewed cloth; number-of-stitches comparison means for comparing the number of stitches detected by the number-of-stitches detection means with a predetermined allowable number of stitches; and display means for displaying a sewing failure, if the number of stitches detected exceeds the predetermined allowable value as a result of the comparison of the number-of-stitches comparison means.

According to a fifth aspect of the invention, the sewing machine controller further comprises; number-of-thread-cutting-times detection means for detecting the number of thread cutting times of the sewed cloth; number-of-thread-cutting-times comparison means for comparing the number of thread cutting times detected by the number-of-thread-cutting-times detection means with a predetermined allowable number of thread cutting times; and display means for displaying a sewing failure, if the number of thread cutting times detected exceeds the predetermined allowable value as a result of the comparison of the number-of-thread-cutting-times comparison means.

DETAILED DESCRIPTION OF THE PREFERRED EMBODIMENTS (Embodiment 1)

Figure 1:
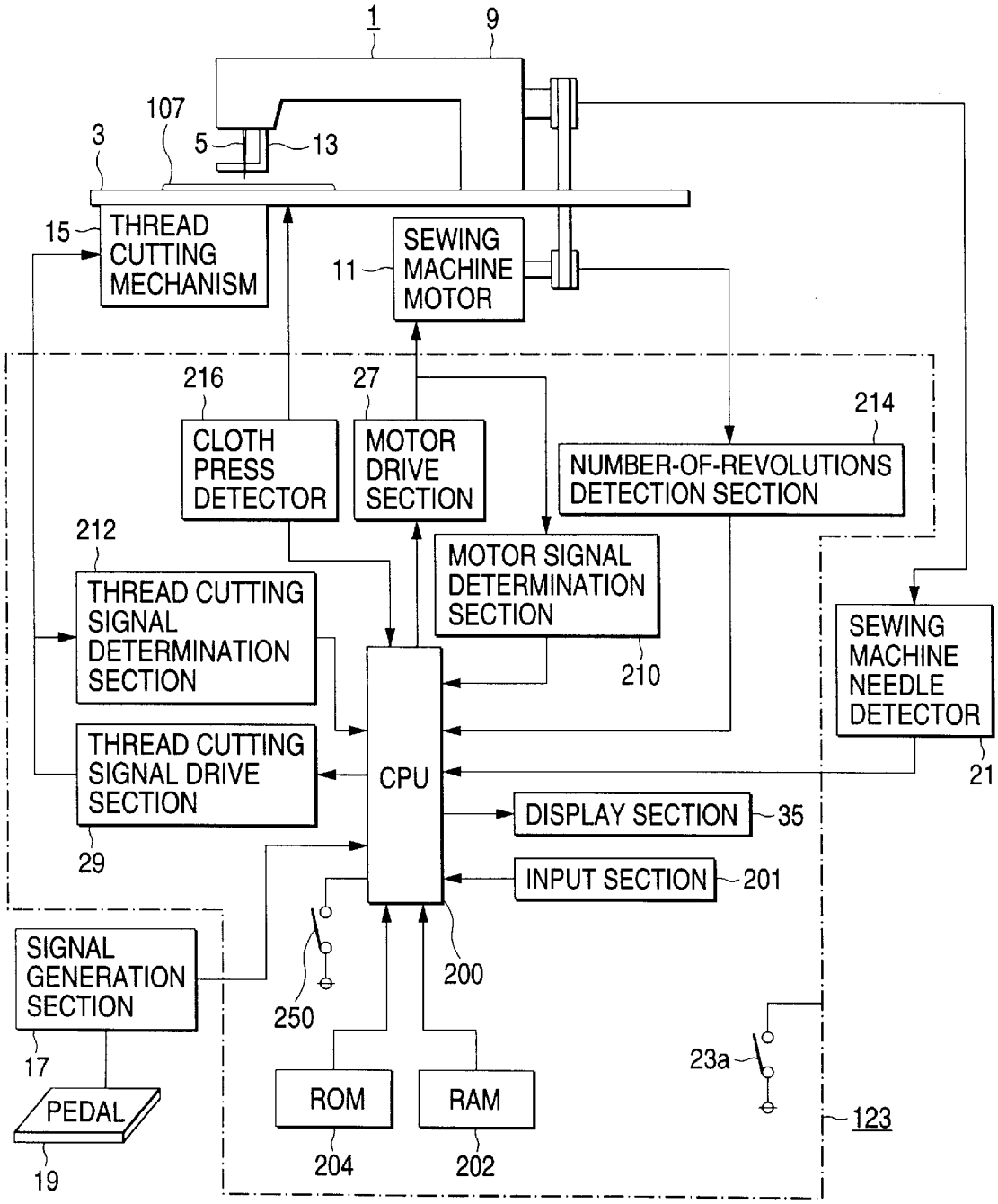
FIG. 1 is a block diagram of a sewing machine controller of a first embodiment of the invention.
Figure 6:
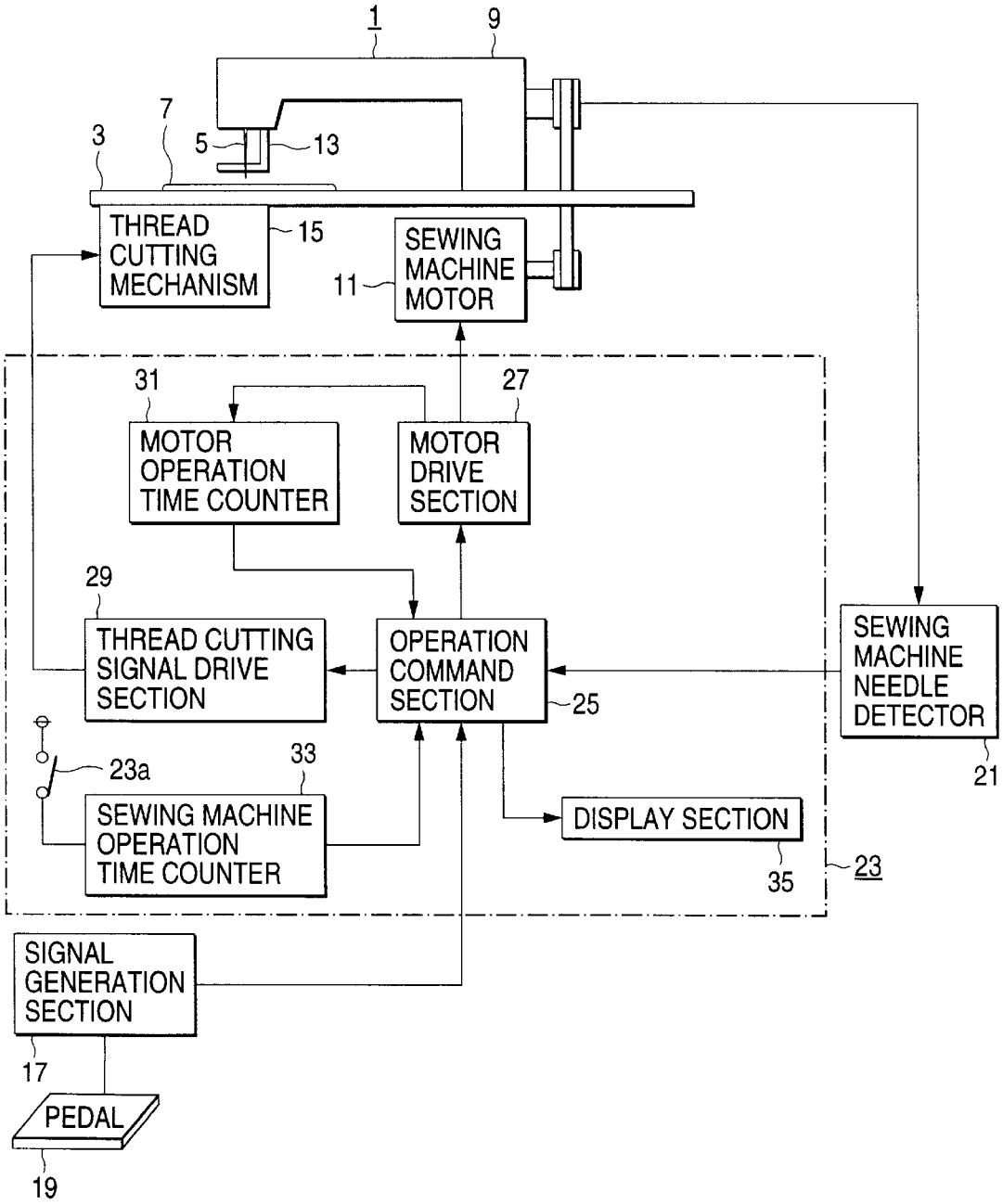
FIG. 6 is a block diagram of a conventional sewing machine controller.

A first embodiment of the invention will be discussed with reference to FIG. 1. FIG. 1 is a block diagram of a sewing machine controller. Parts identical with or similar to those previously described with reference to FIG. 6 are denoted by the same reference numerals in FIG. 1 and will not be discussed again. In FIG. 1, a sewing machine controller 123 comprises a CPU (central processing unit) 200 for counting the time such as the operation time of a sewing machine motor 11, etc., performing operations, etc., an input section 201 consisting of a keyboard and the like, a RAM (random access memory) 202 for storing programs of operation means for operating the CPU 200, a ROM (read-only memory) 204 for storing basic programs for operating the CPU 200, a motor signal determination section 210 for determining whether an output signal of a motor drive section 27 is on or off, a thread cutting signal determination section 212 for determining whether an output signal of a thread cutting drive section 29 is on or off, a number-of-revolutions detection section 214 of an encoder, etc., for detecting the number of revolutions of the sewing machine motor 11, a cloth press section detector 216 for detecting a cloth press section 13 pressing and holding cloth 107 as a sewed piece of cloth, and a finish switch 250 turned on each time one piece of cloth 107 is complete.

Figure 2:
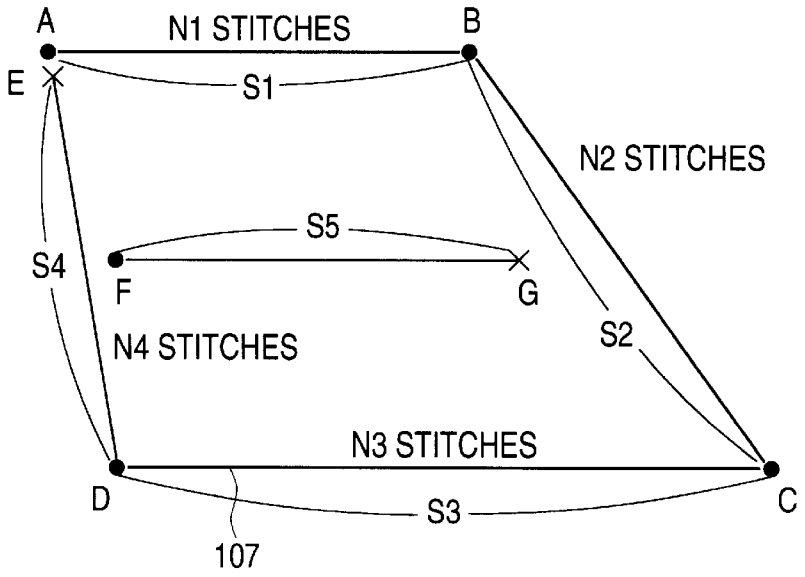
FIG. 2 is a plan view to show a sewing pattern of a sewed piece of cloth and the number of stitches.
Figure 3:
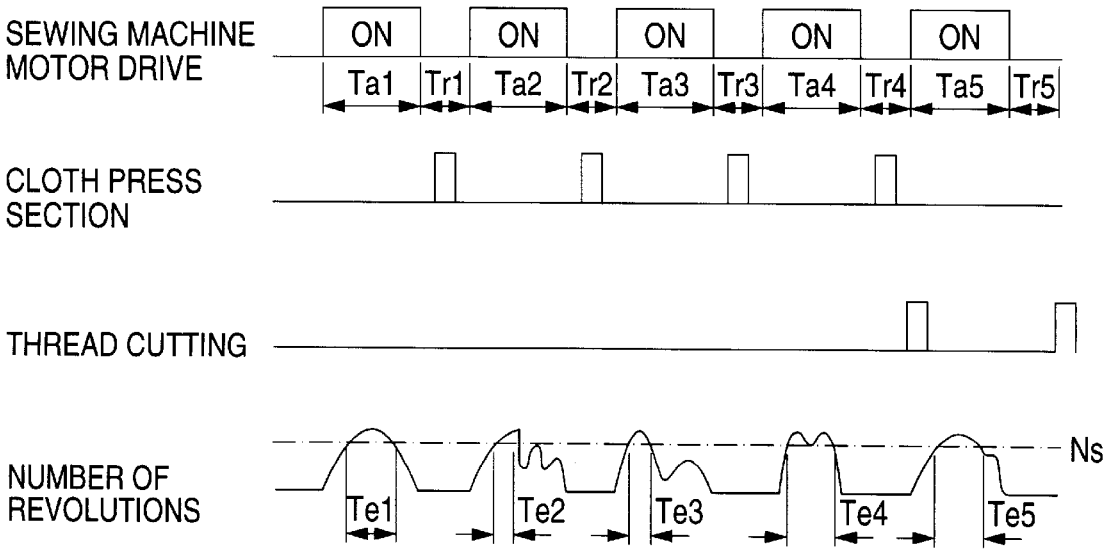
FIG. 3 is a timing chart for sewing in FIG. 2 with the sewing machine controller in FIG. 1.
Figure 4:
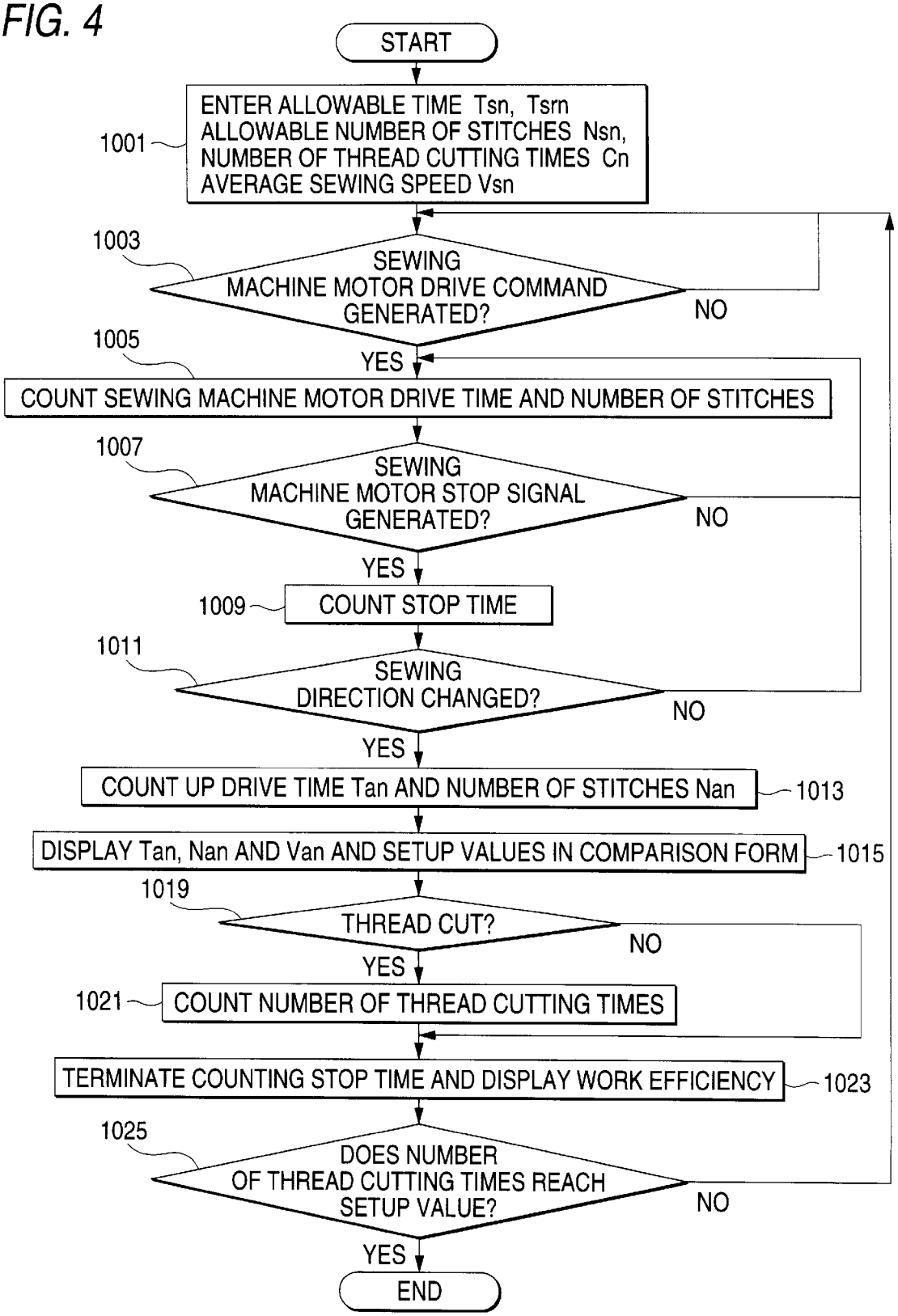
FIG. 4 is a flowchart to show the operation of the sewing machine controller in FIG. 1.

The operation for sewing cloth 107 in FIG. 2 with the sewing machine controller 123 thus configured will be discussed with reference to a timing chart of FIG. 3 and a flowchart of FIG. 4. FIG. 2 is a plan view to show a sewing pattern of a sewed piece of cloth and the number of stitches; continuous sewing in a constant sewing direction is referred to as a single sewing unit and in the example in FIG. 2, the sewing units are S1 to S5.

First, a worker enters the allowable numbers of stitches Ns1–Ns5 in the sewing units S1–S5 through the input section 201, namely, Ns1 (N1±δ) stitches for the sewing unit S1, Ns2 (N2±δ) stitches for the sewing unit S2, Ns3 (N3±δ) stitches for the sewing unit S3, Ns4 (N4±δ) stitches for the sewing unit S4, and Ns5 (N5±δ) stitches for the sewing unit S5 for storing the values in a one-to-one correspondence with the sewing units in the RAM 202. Since a thread of the cloth 107 is cut at two points E and G, the worker enters the number of thread cutting times, two, through the input section 201 for storing the value in the RAM 202. A large number of pieces of cloth 107 are previously sewed and allowable work time values Ts1–Ts5, allowable stop time values Tsr1–Tsr5, and average sewing speed values Vs1–Vs5 for the sewing units S1–S5 are found in a statistical technique and are entered at step 1001. The average sewing speed is found by dividing a predetermined number of stitches by the time required for putting the number of stitches.

The worker places point A of the cloth 107 just below a sewing machine needle 5 and depresses a pedal 19. The signal generation section 17 generates a drive signal of the sewing machine motor 11 in response to the depressing amount of the pedal 19 at step 1003 and inputs the signal to the CPU 200, which then gives a turning command responsive to the depressing amount of the pedal 19 to the motor drive section 27 for turning the sewing machine motor 11. At the same time, the motor signal determination section 210 goes on and as the sewing machine needle 5 moves up and down, a sewing machine needle detector 21 generates a pulse signal. While counting the drive time Ta1 of the sewing machine motor 11 and the number of stitches Na1, the CPU 200 moves the sewing machine needle 5 up and down through a sewing machine drive mechanism 9 for sewing the sewing unit S1 of the cloth 107 from point A to point B at step 1005. If no drive signal is generated at step 1003, step 1003 is continued.

When the worker takes his or her foot off the pedal 19 after the termination of the sewing unit S1, the signal generation section 17 inputs a stop signal to the CPU 200 at step 1007 and the CPU 200 starts counting the stop time Tr1 at step 1009. The reason why neither the drive time nor the number of stitches are counted up at the step is that sewing the same sewing unit may be continued after the stop signal is generated. If no stop signal is generated at step 1007, step 1007 is continued.

The worker moves the cloth press section 13 up at point B of the cloth 107, releases holding the cloth 107, and changes the sewing direction of the cloth 107. If the cloth press section detector 216 detects the release at step 1011 and the sewing direction is changed, the drive time value Ta1 of the sewing machine motor 11 and the stitch count Na1 in the sewing unit S1 are counted up and the counts are stored in the RAM 202 at step 1013. If the sewing direction is not changed at step 1011, step 1011 is continued.

At the same time, the drive time value Ta1 and allowable value Ts1, the stitch count Na1 and allowable value Ns1, and the sewing speed Va1=Na1/Ta1 and average sewing speed Vs1 are displayed on a display section 35 at step 1015. They are displayed in the comparison form of the values; for example, the numeric values may be simply listed, detection value (Ta1, Na1)/allowable value may be found, or only when the detection value exceeds the allowable value, display may be produced. Particularly, if the stitch count Na1 is beyond the range of the allowable value Ns1, it means a sewing mistake and a sewing mistake message is displayed.

The CPU 200 determines whether or not thread cutting has been performed, based on an output signal of the thread cutting signal determination section 212 of the thread cutting drive section 29 at step 1019. Since thread cutting is not performed at the termination of the sewing unit S1 as shown in FIG. 2, the CPU 200 terminates counting the stop time and compares the stop time value Tr1 with the setup value Tsr1, then displays the values on the display section 35 and also finds the work efficiency by calculating Ta1/(Ta1+Tr1), then displays the result on the display section 35 at step 1023. The stop time Tr1 and the allowable stop time Tsr1 are displayed as the drive time and the allowable drive time are displayed.

Whether or not the number of thread cutting times reaches the setup value is determined at step 1025. Since it does not reach the setup value, two, steps 1003 to 1013 are executed for sewing from point B to point C of the cloth 107, and the drive time value Ta2 and allowable value Ts2 and the stitch count Na2 and allowable value Ns2 are displayed on the display section 35 at step 1015. Step 1019 is executed and the sewing unit S2 is completed. The stop time is counted up and the stop time value Tr2 and the setup value Trs2 are compared with each other and displayed on the display section 35 and work efficiency similar to that described above is displayed at step 1023. They are displayed as in the sewing unit S1.

Next, whether or not the number of thread cutting times reaches the setup value is determined at step 1025. Since it does not reach the setup value, two, steps 1003 to 1023 are executed for sewing from point C to point D of the cloth 107, and the sewing unit S3 is completed. Whether or not the number of thread cutting times reaches the setup value is determined at step 1025.

Since it does not reach the setup value, two, steps 1003 to 1015 are executed for sewing from point D to point E of the cloth 107, and a thread cutting signal is given to the thread cutting drive section 29 for operating the thread cutting mechanism 15 for cutting the thread. Whether or not thread cutting has been performed is determined by the thread cutting signal at step 1019. Since thread cutting has been performed, the number of thread cutting times Cn is counted at step 1021. The CPU 200 terminates counting the stop time and compares the stop time value Tr4 with the setup value Tsr4, then displays the values on the display section 35 and also displays work efficiency similar to that described above at step 1023, then completes the sewing unit S4 and determines whether or not the number of thread cutting times reaches the setup value at step 1025.

Since it does not reach the setup value, two, steps 1003 to 1023 are executed for sewing from point F to point G of the cloth 107, and the sewing unit S5 is completed. Whether or not the number of thread cutting times reaches the setup value is determined at step 1025. Since it reaches the setup value, two, sewing of the cloth 107 is terminated.

When a predetermined number of pieces of the cloth 107 are complete by repeating the operation of the sewing machine as described above, the worker turns off the power switch 23*a* for stopping the sewing machine controller 123.

For example, if the sewing units differ in line sewing, curve sewing, etc., since the work time and the sewing speed are evaluated for each sewing unit, the sewing units lowering the work efficiency become clear, so that the work efficiency can be easily improved.

In the embodiment, the number of thread cutting times is counted and when it reaches a predetermined value, the cloth 107 is assumed to be finish. However, a switch signal of the finish switch 250 may be input to the CPU 200 for finishing the cloth 107. In this case, if the count of the number of thread cutting times does not match the setup value at the termination of the finish switch 250, a sewing mistake is determined to occur and may be displayed on the display section 35.

(Embodiment 2)

Figure 5:
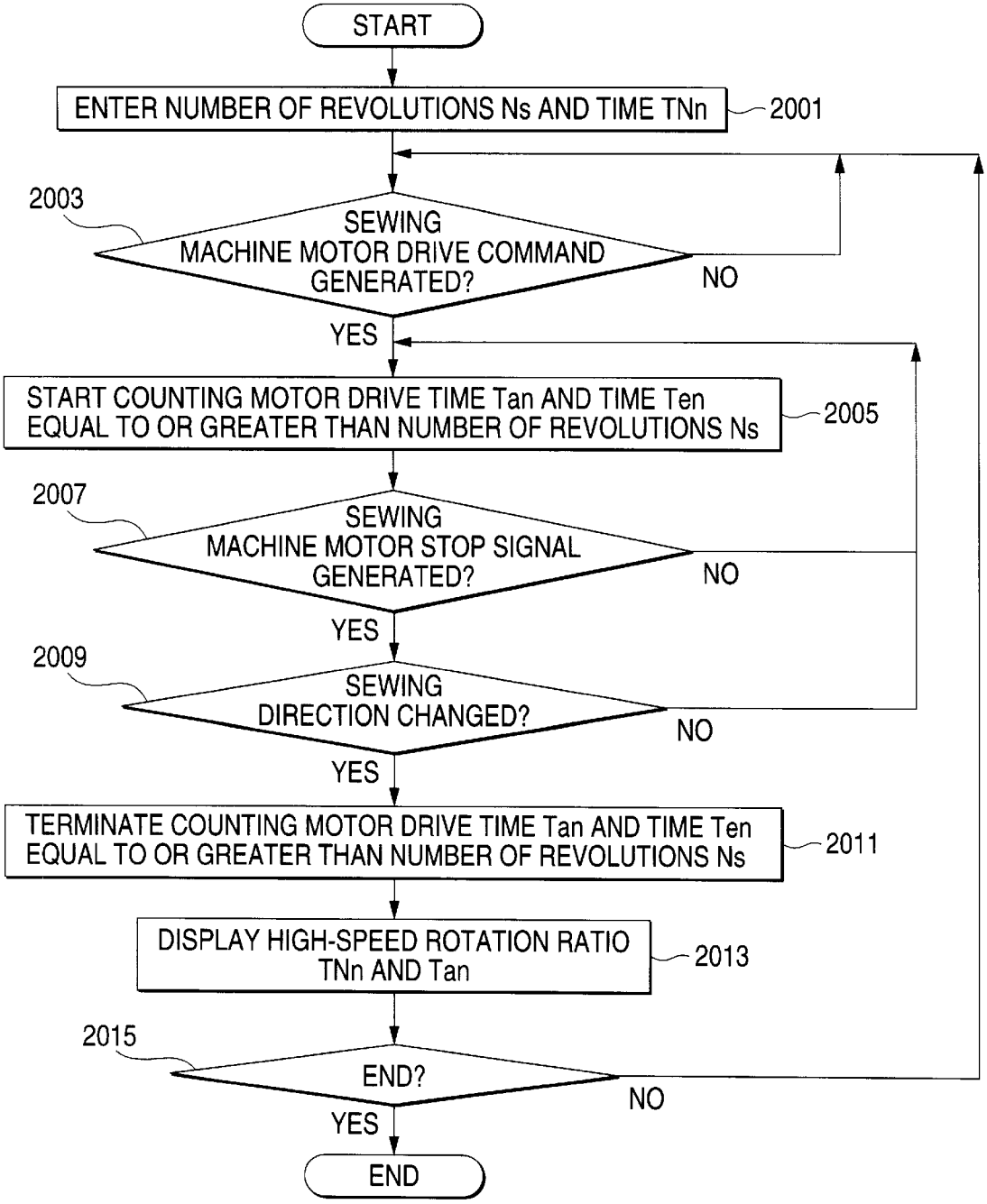
FIG. 5 is a flowchart to show the operation of a second embodiment of the invention.

A second embodiment of the invention will be discussed with reference to FIGS. 1, 2, and 5. In the second embodiment, the depressing amount of a pedal 19 during sewing a piece of cloth is indirectly grasped, whereby whether or not the depressing amount is proper is determined for improving the work efficiency.

The relationship between the depressing amount of the pedal 19 and the number of revolutions of a sewing machine motor 11 is previously measured and the maximum depressing amount of the pedal 19 and the number of revolutions of the sewing machine motor 11 corresponding to the depressing amount close to the maximum depressing amount, Ns, are input through an input section 201 and are stored in a RAM 202 through a CPU 200. Likewise, when cloth 107 is sewed, reference integral time values TN1–TN5 where the number of revolutions of the sewing machine motor 11, Ns, occurs corresponding to sewing units S1–S5 are input through the input section 201 and are stored in the RAM 202 in a one-to-one correspondence with the sewing units through the CPU 200 at step 2001.

The worker places point A of the cloth 107 just below a sewing machine needle 5 and depresses a pedal 19. A signal generation section 17 generates a drive signal of the sewing machine motor 11 in response to the depressing amount of the pedal 19 at step 2003 and inputs the signal to the CPU 200, which then gives a turning command responsive to the depressing amount of the pedal 19 to a motor drive section 27 for turning the sewing machine motor 11 for moving the sewing machine needle 5 up and down through a sewing machine drive mechanism 9 for sewing the sewing unit S1 of the cloth 107 from point A to point B.

At this time, the motor drive section 27 generates a turning command, a motor signal determination section 210 goes on and a turning signal is sent from a number-of-revolutions detection section 214 to the CPU 200, which then counts the drive time Ta1 of the sewing machine motor 11. At the same time, the CPU 200 determines whether or not the number of revolutions is equal to or greater than the setup number of revolutions Ns. If the number of revolutions is equal to or greater than the setup value, the CPU 200 starts counting the good depressing time equal to or greater than the number of revolutions Ns at step 2005.

The worker takes his or her foot off the pedal 19 after the termination of the sewing unit S1. The CPU 200 determines whether or not a stop signal is generated from the signal generation section 17 at step 2007. If a stop signal is generated, the CPU 200 performs following operation.

At point B, the worker moves up a cloth press section 13 for releasing holding the cloth 107 and changes the sewing direction of the cloth 107. When holding the cloth 107 is released, a cloth press section detector 216 detects the sewing direction being changed at step 2011. If the sewing direction is changed, the drive time Ta1 of the sewing machine motor 11 and the good depressing time in the sewing unit are counted up and the value Te1 is stored in the RAM 202 at step 2011. High-speed rotation ratio between the time value Te1 and reference time value Tn1, K=Te1/Tn1, is calculated and the result is displayed on the display section 35 at step 2013. Whether or not sewing the cloth 107 is complete is checked at step 2011. Since a finish switch 250 remains off, steps 2003 to 2015 are repeated for finishing sewing unit S2. Likewise, the high-speed rotation ratio is calculated for each of sewing units S3, S4, and S5 and the results are displayed on the display section 35. Last, when the worker completes the cloth 107 and turns on the finish switch 250, an end signal is generated and sewing one piece of cloth 107 is complete.

In the embodiment, the integral time where the number of revolutions equal to or greater than the number of revolutions Ns occurs is found for each of the sewing units S1–S5. However, the integral time for the entire cloth 107 may be found and compared with the whole reference time value.

When the ratio value is compared with a preset allowable ratio value, if the former is less than the latter, a message indicating improper setting of the number of revolutions of the sewing machine motor 11 may be displayed at step 2013 in addition to display of the ratio values.

As we have discussed, according to the first aspect of the invention, the stop time and the operation time of the sewing machine motor in each part of sewed cloth are compared with predetermined time values and the time values are displayed on the display means. Thus, which sewing unit a loss occurs in can be easily understood and the part in which work efficiency is to be improved can be easily checked.

According to the second aspect of the invention, the sewing speed is computed. Thus, evaluation criteria of the sewing speed, etc., need not previously be entered and work efficiency can be evaluated according to the sewing speed.

According to the third aspect of the invention, cloth can always be sewed in an appropriate depressing amount of the pedal. Thus, the worker need not take care of the depressing amount of the pedal; fatigue of the worker is lessened and sewed cloth can be finished efficiently.

According to the fourth aspect of the invention, whether or not sewed cloth is finished in an appropriate number of stitches can be easily checked, and the work efficiency also containing a quality inspection step can be improved.

According to the fifth aspect of the invention, whether or not sewed cloth is finished at an appropriate number of thread cutting times can be easily checked, and the work efficiency also containing a quality inspection step can be improved.

What is claimed is:

1. A sewing machine controller for sewing cloth moving in a plurality of sewing directions comprising:

a sewing machine motor for moving a sewing machine needle up an down for sewing the sewed cloth;

direction change detection means for detecting a change in a sewing direction of the sewed cloth;

operation time detection means for detecting operation time of said sewing machine motor, when said direction change detection means does not detect a change in the sewing direction;

stop time detection means for detecting stop time of said sewing machine motor, when said direction change detection means does not detect a change in the sewing direction;

stop time comparison means for comparing the stop time value with a first preset time value;

operation time comparison means for comparing the operation time with a second preset time value; and display means for displaying results of said stop time comparison means and said operation time comparison means.

2. A sewing machine controller for sewing cloth having a plurality of sewing directions comprising:

a sewing machine motor for moving a sewing machine needle up and down for sewing the sewed cloth;

direction change detection means for detecting a sewing direction of the sewed cloth being changed;

number-of-stitches detection means for counting the number of stitches put in the sewed cloth;

operation time detection means for detecting operation time of said sewing machine motor, when said direction change detection means does not detect a change in the sewing direction;

sewing speed computation means for computing a sewing speed for each sewing in a constant direction of the sewed cloth based on the operation time value detected by said operation time detection means and the number of stitches counted by said number-of-stitches detection means; and display means for displaying the sewing speed.

3. A sewing machine controller comprising:

rotation time detection means for detecting rotation time of a sewing machine motor for moving a sewing machine needle up and down for sewing sewed cloth;

number-of-revolutions detection means for detecting the number of revolutions of said sewing machine motor;

a time counter operating, if the number of revolutions detected by said number-of-revolutions detection means is greater than a predetermined number of revolutions of said sewing machine motor;

comparison means for comparing a count value of said time counter with a predetermined time value; and display means for displaying the comparison result of said comparison means.

4. The sewing machine controller of claim 1, further comprising:

number-of-stitches detection means for counting the number of stitches put in the sewed cloth;

number-of-stitches comparison means for comparing the number of stitches detected by said number-of-stitches detection means with a predetermined allowable number of stitches; and display means for displaying a sewing failure, if the number of stitches detected exceeds the predetermined allowable value as a result of the comparison of said number-of-stitches comparison means.

5. The sewing machine controller of claim 1, further comprising:

number-of-thread-cutting-times detection means for detecting the number of thread cutting times of the sewed cloth;

number-of-thread-cutting-times comparison means for comparing the number of thread cutting times detected by said number-of-thread-cutting-times detection means with a predetermined allowable number of thread cutting times; and display means for displaying a sewing failure, if the number of thread cutting times detected exceeds the predetermined allowable value as a result of the comparison of said number-of-thread-cutting-times comparison means.

* * * * *

UNITED STATES PATENT AND TRADEMARK OFFICE

CERTIFICATE OF CORRECTION

PATENT NO. : 5,862,768
DATED : January 26, 1999
INVENTOR(S) : Hisaaki TSUKAHARA

It is certified that error(s) appears in the above-identified patent and that said Letters Patent is hereby corrected as shown below:

In column 8, claim 1, line 43, replace "an" with --and--.

Signed and Sealed this

Sixteenth Day of November, 1999

*Attest:*

*Attesting Officer*

Q. TODD DICKINSON

*Acting Commissioner of Patents and Trademarks*